United States Patent [19]

Livesay

[11] 4,425,837

[45] Jan. 17, 1984

[54] VARIABLE DISPLACEMENT AXIAL PISTON MACHINE

[75] Inventor: J. D. Livesay, Tipp City, Ohio

[73] Assignee: General Motors Corporation, Detroit, Mich.

[21] Appl. No.: 305,927

[22] Filed: Sep. 28, 1981

[51] Int. Cl.[3] ..... F01B 3/02

[52] U.S. Cl. ..... 92/71; 92/138; 417/269

[58] Field of Search ..... 92/138, 71, 505, 506; 417/269, 222

[56] References Cited

U.S. PATENT DOCUMENTS

| | | | |
|---|---|---|---|
| 3,062,020 | 11/1962 | Heidorn | 62/196 |
| 3,749,523 | 7/1973 | Wahl, Jr. | 417/269 |
| 4,061,443 | 12/1977 | Black et al. | 417/269 |
| 4,073,603 | 2/1978 | Abendschein et al. | 417/222 |
| 4,108,577 | 8/1978 | Brucken et al. | 417/222 |
| 4,145,163 | 3/1979 | Fogelberg | 417/222 |
| 4,231,713 | 11/1980 | Widdowson et al. | 417/269 |

*Primary Examiner*—Paul E. Maslousky
*Attorney, Agent, or Firm*—R. L. Phillips

[57] ABSTRACT

A variable displacement axial piston machine is disclosed having a piston guide cylinder stationarily aligned with an axial working piston cylinder. A single-headed piston has a piston head at one end reciprocally mounted in the working cylinder and a piston guide at the opposite end reciprocally mounted and guided in the guide cylinder to maintain axial alignment (prevent tilting) of the piston head in its cylinder during piston reciprocation. A shaft is supported for rotation about an axis extending longitudinally of and radially spaced from the piston and its cylinders and a rotary swash plate with flat parallel sides is fixedly drivingly and pivotally interconnected with the shaft so that the swash plate rotates with the shaft while being pivotal about a pivot axis transverse to the shaft axis. The piston is slidably drivingly and pivotally interconnected with the sides of the swash plate so that the piston reciprocates on rotation of the shaft and vice versa and wherein the piston stroke and thereby displacement is made to vary by pivoting the swash plate to various angles relative to the shaft. Moreover, there is provided axial compensation in the drive arrangement between the piston and swash plate for maintaining continuous sliding drive engagement therebetween to compensate for the change in effective axial thickness between the swash plate sides relative to the piston when the angle of the swash plate is changed.

4 Claims, 4 Drawing Figures

VARIABLE DISPLACEMENT AXIAL PISTON MACHINE

This invention relates to a variable displacement axial piston machine and more particularly to a variable displacement axial piston machine having a variable angle swash plate.

In variable displacement axial piston machines, it is common practice to employ a variable angle non-rotary socket plate and rotary wobble plate assembly between the pistons and the input or output shaft to vary piston stroke and thereby displacement; there being an input shaft in such machines as in the case of a compressor and an output shaft as in the case of a motor or engine. For example, such a variable displacement mechanism has been proposed for use in automotive air conditioning compressors as can be seen in U.S. Pat. No. 4,108,577 wherein the angle of the wobble plate is controlled by a servo and in U.S. Pat. No. 4,073,603 wherein the wobble plate angle is varied by controlled crankcase pressure. As can be seen in these patents, this type of variable displacement mechanism requires a substantial number of parts to accommodate the variable angle wobble plate. For example, such a variable angle wobble plate typically requires bearing support and retention of the socket plate as well as rotary prevention thereof, socketed connecting rod linkage with the pistons, etc.

The variable displacement axial piston machine according to the present invention uses a variable angle rotary swash plate whereby there is no need for the many parts normally required to incorporate a variable angle wobble plate. This is accomplished in the preferred embodiment by providing a piston guide cylinder stationarily aligned with each axial piston cylinder. A single-headed piston is then provided having a piston head at one end reciprocally mounted in the piston cylinder and a piston guide at the opposite end reciprocally mounted and guided in the piston guide cylinder to thereby maintain axial alignment of the piston head in its cylinder during piston reciprocation. A shaft is supported for rotation about an axis extending longitudinally of and spaced from the aligned piston and piston guide cylinders and a rotary swash plate with flat parallel sides is fixedly drivingly and pivotally interconnected therewith so that the swash plate rotates with the shaft while being pivotal transverse to the shaft axis. A simple drive arrangement is then provided for slidably drivingly and pivotally interconnecting the sides of the swash plate with the piston to effect reciprocation of the piston on rotation of the shaft and vice versa and wherein the piston stroke and thereby displacement is made to vary by pivoting the swash plate to various angles relative to the shaft axis. Moreover, there is provided axial compensation between the swash plate and piston for maintaining continuous sliding drive engagement between the piston and both sides of the swash plate to compensate for the change in effective axial thickness between the swash plate sides relative to the piston when the angle of the swash plate is changed.

These and other objects, advantages and features of the present invention will become more apparent from the following description and drawing in which.

Figure 1:
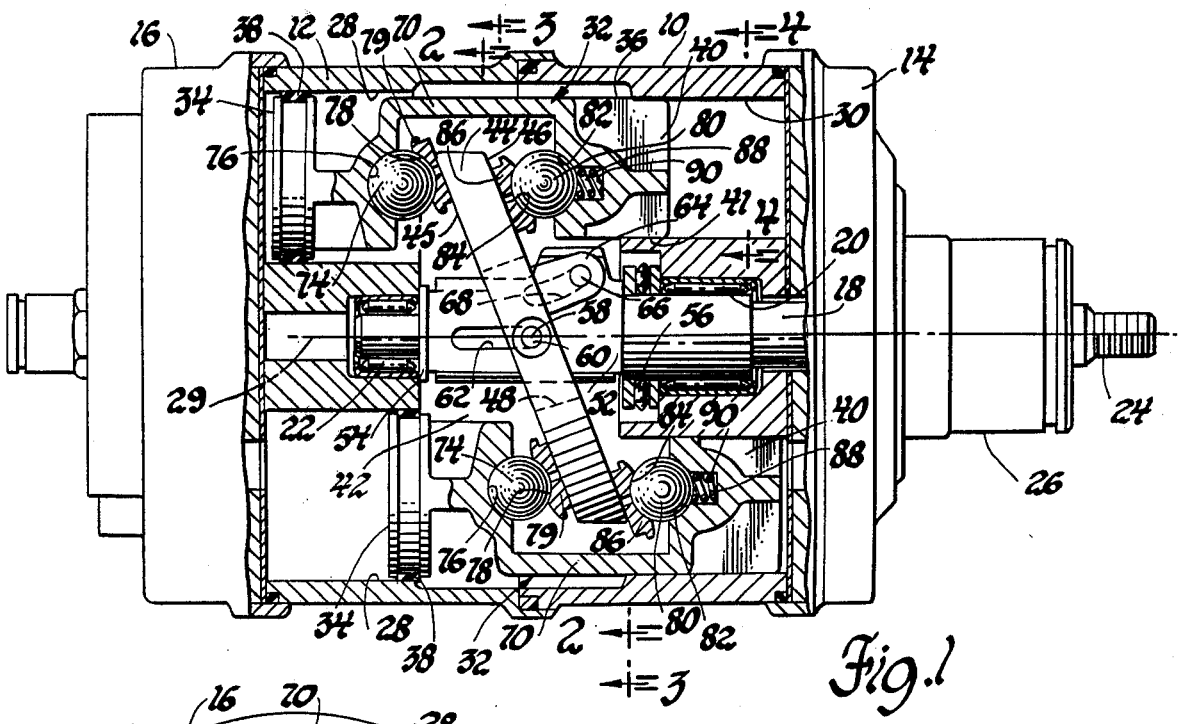
FIG. 1 is a side view with parts broken away showing the preferred embodiment of the variable displacement axial piston machine according to the present invention.
Figure 2:
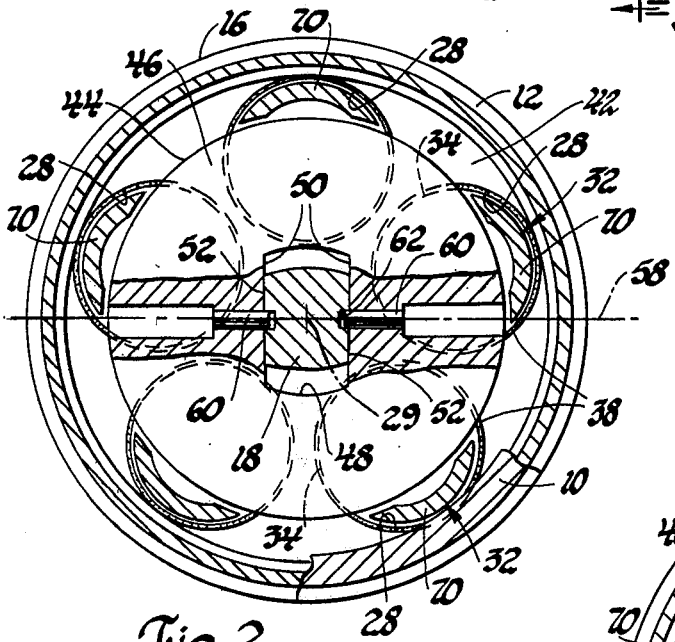
FIG. 2 is a view taken along the line 2—2 in FIG. 1.
Figure 3:
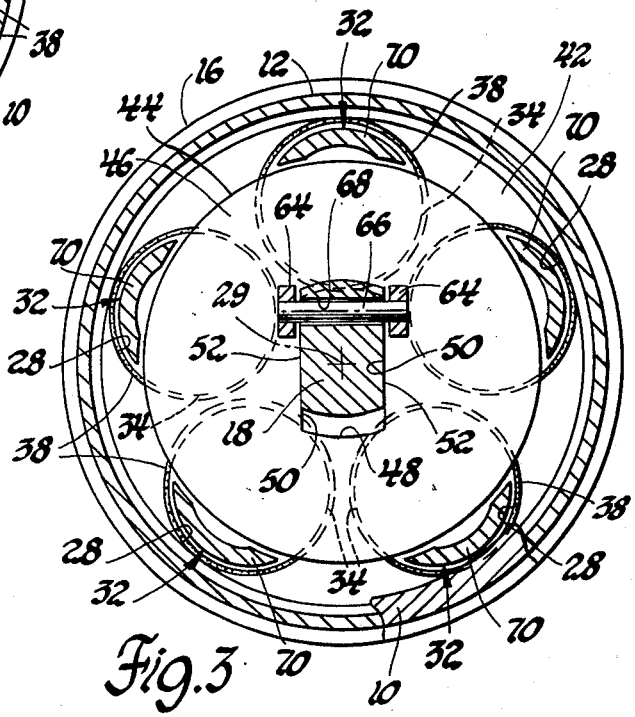
FIG. 3 is a view taken along the line 3—3 in FIG. 1.

Referring to FIG. 1, there is shown the preferred embodiment of the variable displacement axial piston machine according to the present invention adapted for use as an automotive air conditioning compressor. The machine or compressor in this case comprises a housing having a two-piece cylinder block 10, 12 with heads 14 and 16 secured to the opposite ends thereof. A shaft 18 is supported centrally in the housing in the cylinder block halves 10 and 12 by needle bearings 20 and 22 respectively and extends through the head 14 for connection at its end 24 to an automotive engine (not shown) such as by an electromagnetic clutch (also not shown) which would be mounted on a tubular extension 26 provided on the head 14. As seen in FIGS. 1, 2 and 3, the left-hand cylinder block half 12 has five (5) equally angularly spaced axial working piston cylinders 28 extending parallel to and equally radially spaced from the axis 29 of shaft 18. The right-hand cylinder block half 10 does not have working piston cylinders as such and instead, has a complementary number of axial piston guide cylinders 30 which are of smaller diameter and are axially aligned with the respective axial working piston cylinders 28.

Figure 4:
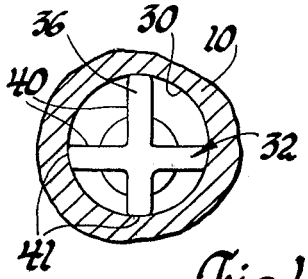
FIG. 4 is a view taken along the line 4—4 in FIG. 1.

A single-headed piston 32 is reciprocally mounted in each set of the axially aligned working piston cylinders 28 and guide cylinders 30 with each piston comprising a piston head 34 at one end reciprocally mounted in the respective working piston cylinder 28 and a piston guide 36 at the opposite end reciprocally mounted and guided in the respective piston guide cylinder 30. Each piston head 34 is provided with a seal 38 while the piston guide 36 at the opposite end does not require sealing and, instead, is formed with four (4) longitudinally and radially extending right-angle guide ribs 40 which form an X-cross-section as shown in FIG. 4. The ribs 40 have a partial cylindrical surface 41 at their radial end with a common diameter smaller than that of the piston head 34 and slide at these surfaces on the guide cylinder 30 to thereby maintain axial alignment (prevent tilting) of the piston head in its cylinder during piston reciprocation. The working piston cylinders 28 are provided with a conventional intake and exhaust valve arrangement in and at the head 16 while on the other hand, the guide cylinders 30 are open to the crankcase interior 42 of the cylinder block past the respective piston guide end 36 between its guide ribs 40.

A rotary swash plate 44 with flat parallel sides 45 and 46 for driving the pistons 32 is fixedly, drivingly and pivotally interconnected with the shaft 18 so that the swash plate rotates with the shaft while being pivotal transverse to the shaft axis to vary the piston stroke and thus the displacement. This interconnection is provided by forming a central opening 48 in the swash plate 44 of generally rectangular shape which receives the shaft 18 and has flat parallel sides 50 that are drivingly engaged by flat parallel sides 52 formed on the shaft. The flat sides 52 of the shaft 18 extend longitudinally thereof between the two supporting needle bearings 20 nd 22 while sufficient clearance is left in the swash plate opening 48 between its other sides and the shaft as shown in FIG. 2 to allow the desired angulation of the swash plate 44. The rectangular section of the shaft 18 extends sufficiently beyond both sides 45 and 46 of the swash plate 44 to maintain driving engagement with the shaft at all angles of the swash plate and the shaft is retained in a fixed axial location by a thrust washer 54 at the inner end of the needle bearing 22 and a needle thrust bearing 56 at the inner end of the other needle bearing 20.

The swash plate 44 is pivotal about an axis 58 which intersects at right angles with and is movable along the shaft axis 29 by means of a pair of radial pivot pins 60 which are press-fitted at diametrically opposite locations in the swash plate 44 and have their inner end guided in an axially extending guide groove 62 in the respective flat side 52 of the shaft. Axial movement of the swash plate 44 while pivoting about the axis 58 is guided by a pin and guide arrangement comprising a pair of arms 64 which are fixed to and project from the side 46 of the swash plate and have secured thereto near their end a pin 66 which is at right angles to and radially spaced from the shaft axis 29. The guide pin 66 is guided in an arcuate slot 68 formed in the shaft 18 and operates to guide the pin 66 and thereby the swash plate 44 such that as the swash plate is forced to move toward a perpendicular position relative to the shaft, the swash plate is forced by the pins 60 and guide grooves 62 to move leftward as shown in FIG. 1 and displace all the pistons 32 therewith to maintain a constant clearance volume (head clearance) in the working cylinders 28.

The swash plate 44 is slidably drivingly and pivotally interconnected at its sides 45 and 46 with the pistons 32 to effect their reciprocation on rotation of the shaft. This is provided by forming each of the pistons 312 with a bridge 70 over the periphery of the swash plate 44 so that its sides 45 and 46 are located interior of each piston opposite their piston head 34 and piston guide end 36. On the piston head side, there is then provided at each piston a ball 74 which engages both a socket 76 in the piston on one side of the bridge 70 and a socket 78 in a shoe 79 which slidably engages the swash plate side 45. Then on the opposite side of the swash plate, there is similarly provided a ball 80 which engages both a socket 82 in the piston on the opposite side of the bridge 70 and a socket 84 in a shoe 86 which slidably engages the swash plate side 46. As the angle of the swash plate 44 is changed relative to the shaft axis 29, the effective axial thickness between the swash plate sides 45 and 46 relative to the pistons 32 also changes with such effective swash plate thickness decreasing as the swash plate angle moves toward the perpendicular. To compensate for this change, there is provided on each piston a coil spring 88 which is preloaded in a cavity 90 in the bottom of the piston's guide-end side socket 82. The preloaded spring 88 on each piston acts on the respective ball 80 to maintain continuous engagement of the sliding shoe 86 with the swash plate side 46 in all angular positions of the swash plate 44 and accompanying change in effective swash plate thickness.

With the above variable angle swash plate arrangement, the angle of the swash plate may be controlled by a servo or by controlled crankcase pressure as disclosed in the earlier mentioned U.S. Pat. Nos. 4,108,577 and 4,073,603 which are hereby incorporated by reference. In either event, the torque transmission between the swash plate 44 and the shaft 18 is taken by the engagement between their flat sides 50 and 52 while the angle of the swash plate is changed under the guidance of the two sliding pivot connections 60, 62 and 66, 68. As the swash plate 44 is rotated by the shaft 18 at whatever angle, the ball and sliding shoe drive connections 74, 79 and 80, 86 effect reciprocation of the non-rotary pistons 32 except, of course, when the swash plate is perpendicular to the shaft in which case there would be no piston reciprocation and thus zero displacement. As the swash plate 44 is angled off perpendicular, the stroke of the pistons 32 and thus the displacement is increased while the preloaded spring 88 in the pistons operates to compensate for the changing effective thickness of the swash plate so that there is in effect zero clearance between the swash plate sides 45, 46 and the pistons at all angles of the swash plate.

It will be understood by those skilled in tha art that the present invention is also readily adaptable for use in other variable displacement axial piston machines including engines where the single shaft then becomes the output shaft rather than the input shaft and that the above described preferred embodiment is thus illustrative of the present invention which may be modified within the scope of the appended claims.

The embodiments of the invention in which an exclusive property or privilege is claimed are defined as follows:

1. A variable displacement axial piston machine having piston guide means stationarily aligned with an axial working piston cylinder, a single-headed piston having a piston head at one end reciprocally mounted in said working piston cylinder and piston guide means at the opposite end for cooperating with said first-mentioned guide means to prevent tilting of said piston head in said working piston cylinder during piston reciprocation, a shaft supported for rotation about a rotary axis extending longitudinally of and radially spaced from said piston, a rotary swash plate with flat parallel sides, swash plate-shaft drive means for fixedly drivingly and pivotally interconnecting said swash plate and shaft so that said swash plate rotates with said shaft while being pivotal about a pivot axis transverse to said rotary axis, swash plate-piston drive means for slidably drivingly and pivotally interconnecting said sides of said swash plate with said piston to effect reciprocation of said piston on rotation of said shaft and vice versa and wherein the piston stroke and thereby displacement is made to vary by pivoting said swash plate to various angles relative to said shaft, and said swash plate-piston drive means including axial compensating means for maintaining continuous sliding drive engagement between said piston and both sides of said swash plate to automatically compensate for the change in effective axial thickness between said sides relative to said piston when the angle of said swash plate is changed.

2. A variable displacement axial piston machine having a piston guide cylinder stationarily aligned with an axial working piston cylinder, a single-headed piston having a piston head at one end reciprocally mounted in said working piston cylinder and a guide surface at the opposite end reciprocally mounted and guided in said guide cylinder to prevent tilting of said piston head in said working piston cylinder during piston reciprocation, a shaft supported for rotation about a rotary axis extending longitudinally of and radially spaced from said piston, a rotary swash plate with flat parallel sides, swash plate-shaft drive means for fixedly drivingly and pivotally interconnecting said swash plate and shaft so that said swash plate rotates with said shaft while being pivotal about a pivot axis transverse to said rotary axis and simultaneously guided to move to certain axial positions along said shaft, swash plate-piston drive means for slidably drivingly and pivotally interconnecting said sides of said swash plate with said piston to effect reciprocation of said piston on rotation of said shaft and vice versa and wherein the piston stroke and thereby displacement is made to vary while constant clearance volume is maintained in said working piston cylinder by pivoting said swash plate to various angles relative to said shaft while also moving said swash plate to predetermined axial positions along said shaft by guidance of said swash plate-piston drive means, and said swash plate-piston drive means including axial compensating means for maintaining continuous sliding drive engagement between said piston and both sides of said swash plate to automatically compensate for the change in effective axial thickness between said sides relative to said piston when the angle of said swash plate is changed.

3. A variable displacement axial piston machine having piston guide means stationarily aligned with an axial working piston cylinder, a single-headed piston having a piston head at one end reciprocally mounted in said working piston cylinder and piston guide means at the opposite end for cooperating with said first mentioned guide means to prevent tilting of said piston head in said working piston cylinder during piston reciprocation, a shaft supported for rotation about a rotary axis extending longitudinally of and radially spaced from said piston, a rotary swash plate with flat parallel sides, swash plate-shaft drive means for fixedly drivingly and pivotally interconnecting said swash plate and shaft so that said swash plate rotates with said shaft while being pivotal about a pivot axis transverse to said rotary axis, socketed ball and sliding shoe drive means for slidably drivingly and pivotally interconnecting said sides of said swash plate with said piston to effect reciprocation of said piston on rotation of said shaft and vice versa and wherein the piston stroke and thereby displacement is made to vary by pivoting said swash plate to various angles relative to said shaft, and said socketed ball and sliding shoe means including preloaded spring means for maintaining continuous sliding drive engagement between said piston and both sides of said swash plate to compensate for the change in effective axial thickness between said sides relative to said piston when the angle of said swash plate is changed.

4. A variable displacement axial piston machine having a piston guide cylinder stationarily aligned with an axial working piston cylinder, a single-headed piston having a piston head at one end reciprocally mounted in said working piston cylinder and radially extending guide rib means at the opposite end reciprocally mounted and guided in said guide cylinder to prevent tilting of said piston head in said working piston cylinder during piston reciprocation, a shaft supported for rotation about a rotary axis extending longitudinally of and radially spaced from said piston, a rotary swash plate with flat parallel sides, swash plate-shaft drive means for fixedly drivingly and pivotally interconnecting said swash plate and shaft so that said swash plate rotates with said shaft while being pivotal about a pivot axis at right angles to said rotary axis and simultaneously guided to certain axial positions along said shaft, said swash plate-shaft drive means including a central opening in said swash plate through which said shaft extends having opposing sides engaged by corresponding but longitudinally extending sides on said shaft to transmit all the torque therebetween at all angles and axial positions of said swash plate relative to said shaft, socketed ball and sliding shoe drive means for slidably drivingly and pivotally interconnecting said sides of said swash plate with said piston to effect reciprocation of said piston on rotation of said shaft and vice versa and wherein the piston stroke and thereby displacement is made to vary while constant clearance volume is maintained in said working piston cylinder by pivoting said swash plate to various angles relative to said shaft while also moving said swash plate to predetermined axial positions along said shaft by guidance of said swash plate-shaft drive means, and said socketed ball and sliding shoe drive means including preloaded spring means mounted on said piston for maintaining continuous sliding drive engagement between said piston and both sides of said swash plate to compensate for the change in effective axial thickness between said sides relative to said piston when the angle of said swash plate is changed.

* * * * *